United States Patent [19]

Sartor

[11] Patent Number: 4,934,074

[45] Date of Patent: Jun. 19, 1990

[54] LEVER STRUCTURE PARTICULARLY FOR SKI BOOTS

[75] Inventor: Mariano Sartor, Montebelluna, Italy

[73] Assignee: Nordica S.p.A., Montebelluna, Italy

[21] Appl. No.: 305,325

[22] Filed: Feb. 2, 1989

[30] Foreign Application Priority Data

Feb. 9, 1988 [IT] Italy ..... 82510 A/88

[51] Int. Cl.[5] ..... A43B 5/04

[52] U.S. Cl. ..... 36/119; 36/117

[58] Field of Search ..... 36/117–121, 36/50; 24/68 SK, 69 SK, 70 SK, 71 SK, 71 ST

[56] References Cited

U.S. PATENT DOCUMENTS

| | | | |
|---|---|---|---|
| 3,545,106 | 12/1970 | Martin | 36/50 |
| 4,379,370 | 4/1983 | Balbinot | 36/121 |
| 4,706,393 | 11/1987 | Marxer | 36/117 |
| 4,719,710 | 1/1988 | Pozzabon | 36/119 |

FOREIGN PATENT DOCUMENTS

| | | | |
|---|---|---|---|
| 807878 | 3/1969 | Canada | 24/71 ST |
| 300955 | 1/1989 | European Pat. Off. | 36/117 |
| 1325825 | 3/1963 | France | 36/50 |

*Primary Examiner*—Paul T. Sewell
*Assistant Examiner*—Andrew D. Meyers
*Attorney, Agent, or Firm*—Guido Modiano; Albert Josif

[57] ABSTRACT

The lever structure has an essentially longitudinal body which is not intended to be coupled to a boot. A first seat is provided on the body for accommodating a terminal end of a traction element associated with a presser arranged inside a ski boot. The other end of the body constitutes a transmission point for the traction element during tensioning, and a pair of longitudinal wings protrudes from the body at the transmission point to define a guide for the tensioning element, thereby allowing tensioning of the traction element proportional to the distance between the seat and the transmission point of the traction element.

8 Claims, 1 Drawing Sheet

LEVER STRUCTURE PARTICULARLY FOR SKI BOOTS

BACKGROUND OF THE INVENTION

The present invention relates to a lever structure particularly for ski boots.

Many lever structures are currently known. Some levers are pivoted and/or articulated directly to the shell or to the quarters of the boot, for example by means of prearranged pivots or pins having ends which are generally associated with supports provided on the boot. Alternatively, some levers are associated with ski boots by means of connecting rods articulated, at their ends, to the lever structure and to the boot.

All these known types of lever are therefore composed of a plurality of elements which are necessarily assembled and then mounted on the boot, but such assembly steps increase overall costs.

Lever structures of the type having an eccentricity at one end are also known, the end of a cable being pivoted to said eccentricity.

In this known type of structure, the degree of tensioning of the cable is determined exclusively by the distance between the pivoting point of the end of the cable and the surface of the boot.

This limits the application of this lever structure to cables which require only very limited tensioning. Furthermore, this known lever structure necessarily protrudes with respect to the surface of the boot, thus altering its aesthetic appearance and being susceptible to possible impact and therefore to damage.

Levers are also known which have a plurality of transverse sets of teeth which interact with a hook associated with the end of a cable.

Though these levers allow cable takeup and tensioning, they nonetheless compulsorily require the skier to precisely couple the hook with the teeth every time the boot is put on. This operation is not always easy, as the skier usually wears gloves which limit the precision and sensibility of his movements.

SUMMARY OF THE INVENTION

The aim of the present invention is therefore to eliminate the disadvantages described above in known types by providing an extremely economical lever structure.

Within the scope of the above described aim, another important object is to provide a lever structure which allows appreciable takeup, during closure, of a traction element such as a cable.

Another important object is to obtain a structurally simple lever.

A further object is to provide a lever structure which allows to rapidly and easily tension and slacken a traction element.

Not least object is to provide a lever structure which, in addition to the preceding characteristics that of giving the skier the faculty of not coupling said lever to a traction element.

The above described aim and objects, as well as others which will become apparent hereinafter, are achieved by a lever structure particularly for ski boots, characterized in that it comprises a single essentially longitudinal body which is not coupled to said boot, on which at least one first seat is provided for a terminal end of a traction element associable with said boot, the other end of said body constituting a transmission point for said traction element, said traction element overlaps said transmission point during tensioning, the lever structure further comprising a pair of longitudinal guiding wings protruding from said body at said transmission point for guiding said tensioning element.

Means for adjusting the degree of tensioning of said traction element are advantageously associable with said body at said first seat.

Said traction element is conveniently at least partially elastically deformable or non-extensible.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figures 1, 2, 3, 4:
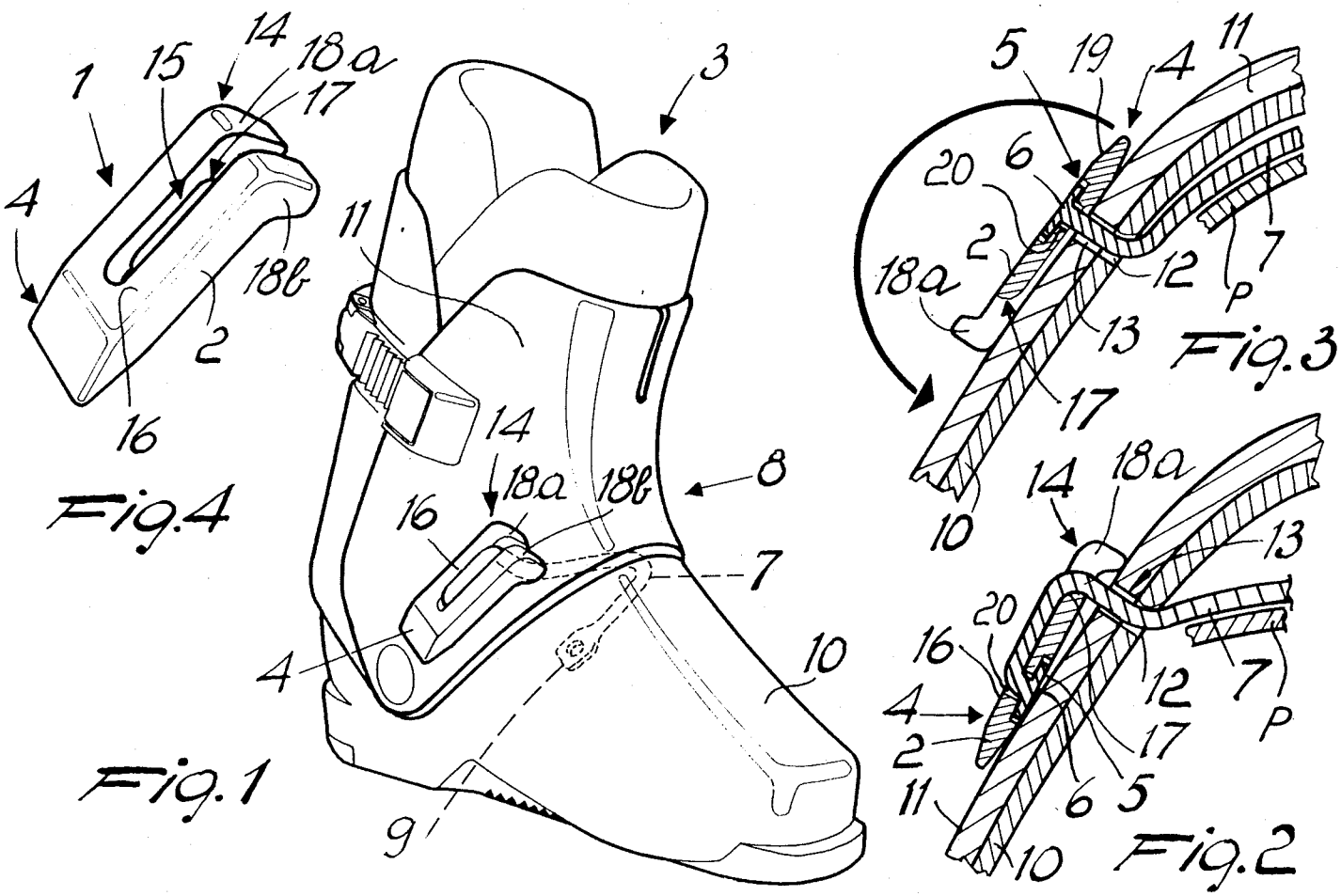
FIG. 1 is a lateral perspective view of a boot with which the lever structure is associated.
FIG. 2 is a partially sectional view, taken along the longitudinal middle axis of the lever structure, of the arrangement of said lever and the traction element with the lever closed.
FIG. 3 is a view, similar to the preceding one, of the open lever condition.
FIG. 4 is a lateral perspective view of the lever structure.

With reference to the above described drawings, the reference numeral 1 indicates a lever structure constituted by a single essentially parallelepipedal body 2.

Said body 2, which has no means for coupling to a ski boot 3, has a first end 4 proximate to which there is a body hole 20 which runs completely through the body 2 from a first surface 19 to a second suface 16. Associated with the body hole 20 at the first surface 19, there is a first seat 5 adapted for accommodating the complementarily shaped terminal end 6 of a traction element 7 preferably constitutd by a cable.

Said cable can be non-extendable or preferably totally and/or partially elastically deformable.

Said traction element 7 may interact for instance, with a foot instep presser P located inside the boot 3, possibly by passing the cable over the presser arranged inside the boot 3 between the shell and the inner boot; in the specific case in which said traction element affects a presser arranged at the foot instep region 8, said traction element has, at its end arranged inside the boot, a fixed cable terminal 9 which can be coupled laterally and internally to the shell 10 of the boot and then transversely embrace the presser and exit laterally to the front quarter 11 through a first hole 12 and a second hole 13 provided respectively laterally on said shell 10 and said front quarter 11.

Starting from the body hole 20 at the first end 4 towards the second end 14, the body 2 furthermore has a second longitudinal seat 15 which partially affects the thickness of said body 2 at the second surface 16 opposite to the first surface 19 where the terminal end 6 of the traction element 7 interacts in abutment engagement relationship with the first seat 5.

A transmission point 17 in the second longitudinal seat 15 for the traction element 7 is thus defined at said second end 14, as shown in FIGS. 2, 3 and 4.

A pair of longitudinal wings **18*a* and 18*b* furthermore protrudes from said body 2 at said second end 14**.

Said pair of wings constitutes a guide for the traction element 7 in the closure step of the lever structure 1; said wings are preferably slightly eccentric in the opposite direction with respect to said surface 16.

The use of the invention is as follows: during the assembly of the boot it is sufficient to couple the traction element 7 to said boot so that the terminal end 6 is external to the shell or to the quarters.

It is then sufficient to associate said terminal end 6 with the body 2 by inserting it in the first seat 5, taking care to associate said terminal end 6 with the body 2 so that said body 2 has its surface 16, and therefore its second longitudinal seat 15, arranged facing the boot at the first hole 12 and at the second hole 13.

Thus, once the terminal end 6 is associated with the first seat 5, the skier can rotate the body 2 anticlockwise, as illustrated in FIG. 3, by gripping the first end 4 of said body 2.

In this manner the traction element 7 is tensioned and arranged within the second longitudinal seat 15, and affects the transmission point 17, guided by the pair of longitudinal wings 18*a* and 18*b*, said point being arranged substantially overlying the holes 12 and 13.

This arrangement entails positioning the traction element 7 above the transmission point 17, said traction element being arranged at the surface 16 of the body 2 which does not face the boot, differently from what occurs in all other known levers.

The degree of tensioning of the traction element 7 is thus adjusted proportionally to the traction, so that the skier can preset the degree of tensioning of said traction element with a single operation performed only once.

Means adapted to further adjust the degree of tensioning of said traction element may furthermore be provided at said first seat 5.

Obviously, any materials, dimensions and contingent shapes may be used according to requirements and the state of the art.

I claim:

1. Lever structure, particularly for a ski boot comprising a shell and at least one presser, said at least one presser being arranged inside said ski boot, said lever structure comprising;

a body, said body being essentially longitudinal, said body being arranged outside said shell of said ski boot, a first end and a second end, said first end and said second end being defined by said body, a first surface and a second surface, said first surface and said second surface being defined by said body, said first surface being opposite to said second surface, a transmission point, said transmission point being defined at said second end of said body, traction element, a terminal end and a fixed end, said terminal end and said fixed end being defined by said traction element, a boot hole being provided in said ski boot, said traction element being inserted in said boot hole so that said terminal end is arranged outside said ski boot and said fixed end is arranged inside said ski boot, said at least one traction element acting on said at least one presser inside said ski boot, said terminal end being at least temporarily connected to said body at said first end thereof, said fixed end being internally connected to said shell of said ski boot, whereby in a non-tension position, said second surface is arranged facing said shell, said first end is arranged substantially above said boot hole, and in a tension position, said body is rotated by substantially 180 degrees so that said first surface is arranged facing said shell, said traction element engages with and runs along said second surface from said first end to said second end where said traction element engages with transmission point, said transmission point is arranged in proximity to said boot hole.

2. Lever structure according to claim 1, further comprising:

at least one body hole, said at least one body hole being provided in said body at said first end thereof, said at least one body hole running through said body from said first surface to said second surface, said traction element being inserted through said at least one body hole.

at least one first seat, said at least one first seat being provided in said first surface of said body, said terminal end of said traction element being at least temporarily arranged inside said at least one first seat, a second longitudinal seat, said second longitudinal seat being provided in said second surface of said body, said second longitudinal seat running along said second surface of said body from said first end, where said at least one body hole is provided, to said second end, said transmission point being defined in said second longitudinal seat at said second end of said body, whereby in a non-locking position, said second surface is arranged facing said shell, said at least one body hole is arranged substantially above said boot hole, and in a locking position, said body is rotated by substantially 180 degrees so that said first surface is arranged facing said shell, said traction element engages with and runs along said second longitudinal seat from said first end to said second end where said traction element engages with said transmission point, said transmission point is arranged substantially above said boot hole.

3. Lever structure according to claim 2, further comprising a pair of longitudinal wings, said pair of longitudinal wings being provided at said second end of said body, whereby when said lever structure is in a locking position, said pair of longitudinal wings act as a guide for said traction element.

4. Lever structure according to claim 2, further comprising a pair of longitudinal wings, said pair of longitudinal wings being provided at said second end of said body, said pair of longitudinal wings being slightly eccentrically raised in a direction towards said first surface of said body, whereby when said lever structure is in a locking position, said pair of longitudinal wings act as a guide for said traction element and said pair of longitudinal wings also act to prevent said body from overturning.

5. Lever structure according to claim 2, wherein adjusting means are furthermore provided at said first seat for adjusting the degree of tensioning of said traction element, said adjusting means interacting with said terminal end of said traction element.

6. Lever structure according to claim 1, wherein said traction element is constituted by at least one cable.

7. Lever structure according to claim 6, wherein said at least one cable is at least partially elastically deformable.

8. Lever structure according to claim 6, wherein said at least one cable is non-extensible.

* * * * *